United States Patent [19]

Burton

[11] Patent Number: 4,901,887

[45] Date of Patent: Feb. 20, 1990

[54] BEVERAGE DISPENSING SYSTEM

[76] Inventor: John W. Burton, #4 Woodland Dr., Pittsburgh, Pa. 15228

[21] Appl. No.: 229,397

[22] Filed: Aug. 8, 1988

[51] Int. Cl.[4] ..... B67D 5/64; B67D 5/62

[52] U.S. Cl. ..... 222/131; 222/129.1; 222/146.6; 222/509; 222/518; 251/353; 239/456; 239/590; 62/396

[58] Field of Search ..... 62/396, 399; 239/590, 239/456; 222/146.6, 513, 514, 518, 509, 129.1, 522, 131; 251/323, 339, 353, 554

[56] References Cited

U.S. PATENT DOCUMENTS

| | | | |
|---|---|---|---|
| 837,934 | 12/1906 | Kerr | 239/590 |
| 894,558 | 7/1908 | Wheaton | 239/590 |
| 1,072,039 | 9/1913 | Sandell | 62/396 |
| 1,907,301 | 5/1933 | Martin | 222/394 |
| 2,105,154 | 1/1938 | Maxon | 239/590 |
| 2,260,958 | 10/1941 | Tomson | 62/396 |
| 2,261,338 | 11/1941 | Carlson | 225/21 |
| 2,262,043 | 11/1941 | Perlick | 222/146.6 |
| 2,331,834 | 10/1943 | Hoft | 222/146.6 |
| 2,838,077 | 6/1958 | Cooper | 141/82 |
| 3,019,946 | 2/1962 | Mueller | 222/180 |
| 3,180,529 | 4/1965 | Buffington | 222/146.6 |
| 3,224,641 | 12/1965 | Morgan | 222/129.1 |
| 3,232,489 | 2/1966 | Buffington | 222/146.6 |
| 3,305,136 | 2/1967 | Harris | 222/129.1 |
| 3,327,902 | 6/1967 | Alterwitz | 222/108 |
| 3,570,525 | 3/1971 | Borsun et al. | 251/354 |
| 3,638,392 | 2/1972 | Welker, Jr. | 53/123 |
| 3,908,394 | 9/1975 | Jacobus | 22/146.6 |
| 4,069,946 | 1/1978 | Flider | 251/353 |
| 4,164,964 | 8/1979 | Daniels | 141/329 |
| 4,518,104 | 5/1985 | Iannelli | 222/106 |
| 4,582,226 | 4/1986 | Doak | 222/148 |
| 4,753,277 | 6/1988 | Holcomb | 141/95 |

*Primary Examiner*—H. Grant Skaggs

[57] ABSTRACT

A beverage dispensing system is provided which utilizes a modified refrigerator/freezer unit, and a tower mounted on top of the refrigerator. Fluid lines run from pressurized bottles inside the refrigerator to dispensing valves mounted on the tower. Artificial ice extends from the freezer unit into the tower. The dispensing system utilizes the refrigerator section of the refrigerator/freezer to chill the beverage lines and reservoirs contained within the refrigerator, and the freezer section to chill the beverage lines extending into the tower.

15 Claims, 1 Drawing Sheet

BEVERAGE DISPENSING SYSTEM

BACKGROUND OF THE INVENTION

1. Field of the Invention

The present invention relates to an apparatus for dispensing liquid beverages constructed from a standard refrigerator with an integral freezer unit, and intended for home use. The apparatus may be used for dispensing beer, soft drinks, fruit juices, and other beverages from beverage containers.

2. Description of the Prior Art

Soft drink and beer dispensers are very well known in the art. They provide an efficient and inexpensive way to serve a high volume of beverages without the time and effort required to dispense individually packaged drinks. These devices, however, are mainly designed for the commercial market.

Similarly, the prior art devices are generally large and not easily moved nor readily installed. They are designed for a commercial market where such a device is installed once and never moved. A device designed for the home market must be portable, easy to install, and less costly. Additionally, any home system should be able to be easily cleaned and repaired. Thus, all parts must be relatively simple to assemble and disassemble, and readily available for replacement.

Finally, the main purpose of most beverage dispensing devices is the maintenance of a low temperature of the drink itself. To achieve that goal, the device must maintain both the reservoir of beverage and the supply lines which ultimately dispense the drink at a low temperature. Chilled supply lines are particularly important in a home system where the device may go several hours without use. If the supply lines are not cooled, the first drink out of the system after a long inactive period will be of unsuitably warm temperature. Beverage lines in a home system must be cooled at a low cost to make the device cost efficient, compared to commercial dispensers which utilize costly, separate coolers.

SUMMARY OF THE INVENTION

A beverage dispensing system is provided which allows for ease of portability, fewer and less costly components, simple cleaning and maintenance, ready availability of replacement parts, and a chilling system which maintains the temperature of the entire liquid circuit. This is accomplished by utilizing a standard refrigerator having an integral freezer unit.

The refrigerator, which may be a full sized or compact model, is modified to mount at least one dispensing valve on the exterior. In one embodiment, a tower is mounted on the top of a compact refrigerator, which contains the fluid lines from inside the box, and upon which the dispensing valves are mounted. This tower is preferably insulated and has an access panel to allow maintenance and repair of the valves.

The valves themselves may be of the standard draft or fountain type, or may be a spring loaded type. This type of valve is operated by depressing the spring loaded mechanism, and disengaged by releasing the same spring loaded mechanism. I prefer to provide a removable diffuser located downstream from the valve in the fluid circuit. This is contrary to the current practice of having the diffuser upstream from the dispensing valve.

Fluid lines are connected to the valves, run down through the interior of the refrigerator and are connected to at least one beverage reservoir within the refrigerator.

Each beverage reservoir is preferably connected to the apparatus by only one fluid line. The beverage reservoirs themselves are removable pressurized containers having an auxiliary or, preferably, a self contained gas charge. This charge is usually $CO_2$ or nitrogen for use in carbonated beverages. In a non-carbonated beverage, the gas can be anything which will not react adversely with the drink. For example, $CO_2$, Nitrogen or any of the inert gases consisting of Helium, Neon, Argon, Krypton and Xenon.

The refrigerator and reservoirs are preferably sized to allow several of the containers to fit within the chilled space. Shelves may be provided within the chilled section to maximize space utilization. The door of the refrigerator may also be adapted to store a number of the reservoirs.

The dispensing system utilizes the refrigerator section of the refrigerator/freezer to chill the beverage reservoirs and the fluid lines contained within the body of the refrigerator cabinet. The freezer section of the refrigerator/freezer unit is utilized to chill the upper sections of the fluid lines, especially the portions which protrude outside the cabinet. This is accomplished by extending a refreezable material into the tower unit, which lies adjacent to the fluid lines both within and without the cabinet. This material, usually an artificial ice strip, is maintained at a freezing temperature by the freezer unit. Thus, the entire fluid line, from beverage reservoir to valve, is cooled by a chilling medium. The freezer may also be utilized to manufacture and dispense ice for use in the dispensed beverages.

These and other advantages and features of the present invention will be more fully understood on reference to the presently preferred embodiments thereof and to the appended drawings.

DESCRIPTION OF THE PREFERRED EMBODIMENTS

Figure 1:
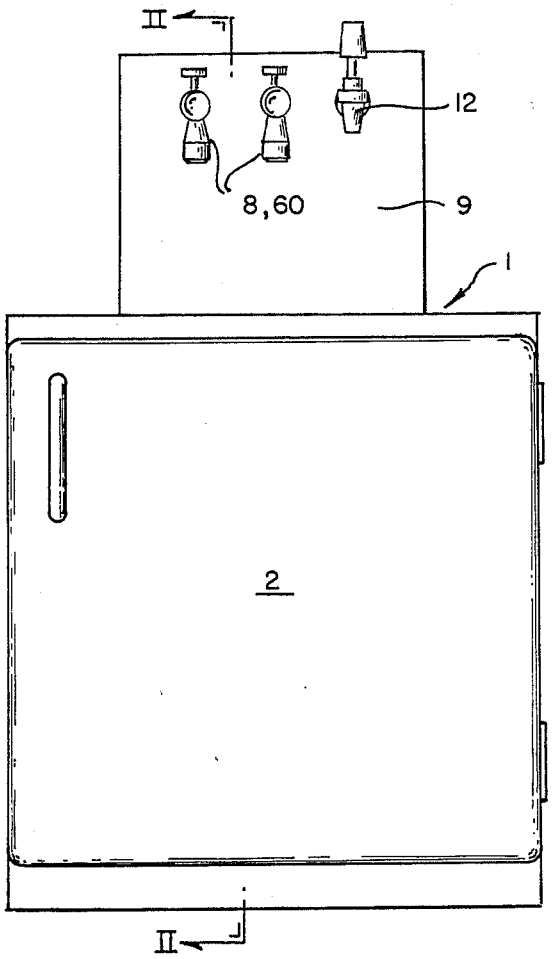
FIG. 1 is a front elevational view of a present preferred embodiment of my beverage dispensing system.
Figure 2:
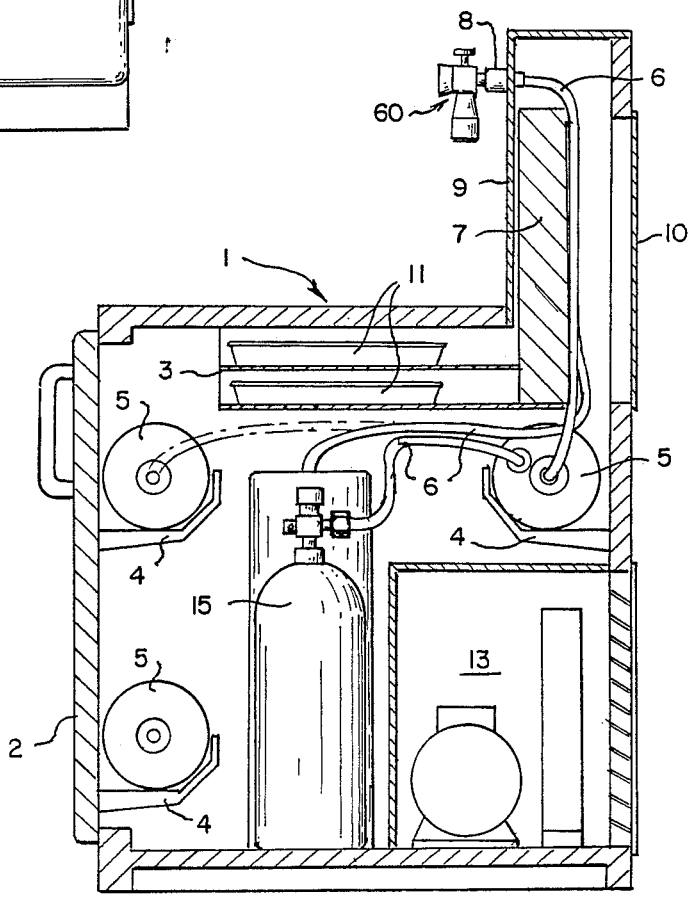
FIG. 2 is a sectional view taken along the line II—II of FIG. 1.

Referring to FIGS. 1 and 2, an improved beverage dispensing system is provided utilizing a standard refrigerator 1, preferably of 2 to 6 cubic feet capacity, having an integral freezer unit 3 and compressor compartment 13. I have found that General Electric's models SC25JC and SC45JC, Emerson's OR300 and OR500, Samsung's SR099G and SR120G, Sears' 96252 and 96363 refrigerators, among others, can be used when modified in accordance with my invention. The dispensing system has a tower 9 mounted atop the cabinet of the refrigerator 1. The tower 9 contains fluid lines 6 connected from beverage reservoirs 5 to the valves. The valves may be of any known type, including a standard beer tap 12 or premix type soda valve, but are preferably of a spring type 8 described subsequently. The fluid lines 6 run from valves 8 through the tower 9 and behind freezer 3 to beverage reservoirs 5 within the refrigerator section of the device. Although I have shown tower 9 mounted on top of the refrigerator, it should be understood that the tower or comparable housing could also be mounted on the door or side of the refrigerator.

The tower 9 also contains an artificial ice strip 7 which is utilized to continuously cool the fluid lines 6. The strip 7 extends into and is itself continuously cooled by the freezer unit 3. The freezer 3 may also hold ice trays 11. The tower is also insulated and has an access panel 10 on the back for access to the valves.

The beverage reservoirs 5, which may be a variety of sizes, are preferably closed systems having an integral gas charge. For carbonated beverages, this charge is $CO_2$. For beer, wine and other beverages damaged by oxidation, nitrogen, argon or other inert gases may be utilized for extended storage. If desired, an external pressure source as such as bottle 15 may be utilized.

I prefer to provide shelf 4 within the chilled space and in door 2 to maximize space utilization. The shelves 4 are adapted to receive and store additional beverage reservoirs 5.

Figure 3:
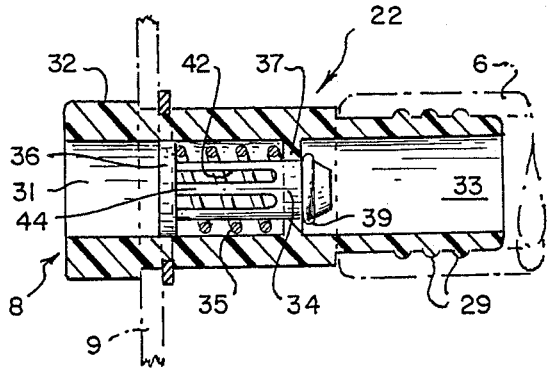
FIG. 3 is a sectional view of one type of valve utilized in the beverage dispensing system.

Referring to FIG. 3, a present preferred embodiment of the valve arrangement 22 is shown for connecting valve 8 to fluid lines 6. A standard pull-type tap may also be utilized. The valve could also be used to connect the fluid lines 6 to the reservoir. The valve consists of a generally cylindrical outer housing 32 with openings 31 and 33. Within housing 32 is an open basket valve 34 for maximum fluid flow which rests on spring 35. This spring is positioned between upper rim 36 of basket 34 and shoulder 37. The basket is closed at its bottom 40, but has a plurality of slots 42 in the side wall 44. The valve is operated by inserting a tube into opening 31. This tube may be the tubular portion 61 of diffuser 60 shown in FIG. 4. Insertion of the tube pushes basket 34 inward opening the valve. When the tube is removed the basket returns to its original position shown in FIG. 3. An exterior seal 39 is provided on the lower portion of the basket 34. Fluid line 6 extends from the bottom portion of the valve. A notch 29 or threads (not shown) can be provided for connecting the valve to the tower 9.

Figure 4:
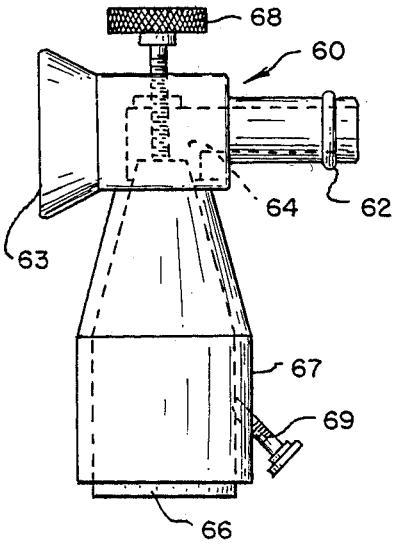
FIG. 4 is an enlarged elevational view of the diffuser valve shown on FIG. 2.

In FIG. 4, a diffuser is shown which can be inserted directly or indirectly into opening 31 of valve 22 in the tower. The diffuser 60 has a cylindrical probe-type end 61 with an O-ring seal 62. As previously stated, that end is inserted into opening 31 of the valve. When the diffuser 60 is depressed, fluid then flows from the supply line 6 through valve 22, passageway 64 and nozzle 67. A land 63 on the nozzle allows one to easily push the nozzle into valve 22. A diffuser cone 66 is provided within the nozzle 67 of the diffuser valve. Cone 66 is moveable relative to the nozzle 67. Movement is controlled by a hand screw 68 or adjusting screw 69 shown in chain line which passes through the nozzle 67 and connects to the diffuser cone 66. The screws enable one to control the amount of carbonation in the liquid being dispensed by regulating the clearance of size of opening through which a liquid may flow.

The diffusers and valves described herein are both easily cleaned and operated, reducing the operating expense of the system. Unlike conventional systems, the diffuser is easily removable for cleaning by pulling it out of the valve bore and immersing it in a standard cleaning fluid. The diffuser may be removed without disengaging any screws, ringnuts or other holding devices.

While I have described a present preferred embodiment of the invention, it is to be distinctly understood that the invention is not limited thereto but may be otherwise embodied and practiced within the scope of the following claims.

I claim:

1. A beverage storage and dispensing system for dispensing fluids from a pressurized container and able to dispense said fluids at a near freezing temperature, comprising:

(a) a refrigerator having an integral freezer and a storage compartment of sufficient size to contain at least one beverage reservoir, (b) a tower attached to the refrigerator adjacent to the freezer and extending outward from the refrigerator, said tower having an interior cavity of sufficient size to contain fluid lines and an ice strip, (c) at least one dispensing valve attached to the tower, (d) at least one fluid line connected to said at least one dispensing valve running through the tower and into the refrigerator and of sufficient size and length to be connected to at least one beverage reservoir within the refrigerator storage compartment, and (e) an ice strip immediately adjacent to the fluid lines and extending from within the interior cavity of the tower into the freezer in a manner which permits the artificial ice strip to be frozen by the freezer and to cool the at least one fluid lines in the tower.

2. A beverage dispensing system as described in claim 1 where the ice strip is an artificial ice strip.

3. A beverage dispensing system as described in claim 1 also comprising a removable access panel in the tower.

4. A beverage dispensing system as claimed in claim 1 wherein at least one valve is of a type being spring loaded and capable of being opened by pushing a probe through a passageway, said probe being a hollow tube having an exterior seal for creating a seal between the probe and valve passageway.

5. The beverage dispensing system of claim 4 wherein the at least one valve is an open basket type valve for maximum fluid flow.

6. A beverage dispensing system as described in claim 4 also having a fluid circuit comprising a diffuser located downstream from the valve.

7. A beverage dispensing system as described in claim 4 wherein the valve is operated by depressing the spring loaded mechanism and disengaged by releasing the same spring loaded mechanism.

8. A beverage dispensing system as described in claim 1 wherein the at least one dispensing valve attached to the tower is removable from the tower.

9. A beverage dispensing system as described in claim 1 wherein each beverage reservoir is connected to the beverage dispensing system by only one fluid line.

10. A beverage dispensing system as described in claim 1 wherein a plurality of beverage reservoirs may be stored within the refrigerator unit.

11. A beverage dispensing system as described in claim 1 wherein the beverage reservoir has a single valve and a self contained gas charge.

12. A beverage dispensing system as described in claim 11 wherein the gas charge is a gas selected from the group consisting of $CO_2$, Nitrogen, Helium, Neon, Argon, Krypton, and Xenon.

13. A beverage dispensing system as described in claim 1 wherein a shelf is provided within the refrigerator and above a compressor housing in the refrigerator.

14. A beverage dispensing system as described in claim 1 wherein the refrigerator has a door, sized and positioned to accept at least one beverage reservoir.

15. A beverage dispensing system as described in claim 1 wherein the freezer unit is adapted to provide ice for utilization in the beverages dispensed by the apparatus.

* * * * *